US007180469B2

(12) United States Patent
Slattman et al.

(10) Patent No.: US 7,180,469 B2
(45) Date of Patent: Feb. 20, 2007

(54) SYSTEM AND METHOD FOR PROVIDING ANTENNA RADIATION PATTERN CONTROL

(75) Inventors: Peter Slattman, Carlsbad, CA (US); John Sanford, Encinitas, CA (US)

(73) Assignee: Cushcraft Corporation, Manchester, NH (US)

( * ) Notice: Subject to any disclaimer, the term of this patent is extended or adjusted under 35 U.S.C. 154(b) by 44 days.

(21) Appl. No.: 11/169,467

(22) Filed: Jun. 29, 2005

(65) Prior Publication Data

US 2007/0001923 A1 Jan. 4, 2007

(51) Int. Cl.
*H01Q 1/42* (2006.01)

(52) U.S. Cl. ..... 343/872; 343/912

(58) Field of Classification Search ..... 343/700 MS, 343/872, 912

See application file for complete search history.

(56) References Cited

U.S. PATENT DOCUMENTS

| | | | | |
|---|---|---|---|---|
| 5,757,331 | A * | 5/1998 | Yoneyama et al. | 343/783 |
| 6,313,809 | B1 * | 11/2001 | Gabriel et al. | 343/797 |
| 6,747,607 | B1 * | 6/2004 | Eckhardt et al. | 343/909 |
| 6,943,732 | B2 * | 9/2005 | Gottl et al. | 343/700 MS |
| 7,075,498 | B2 * | 7/2006 | Gottl et al. | 343/797 |
| 7,084,836 | B2 * | 8/2006 | Espenscheid et al. | 343/914 |

* cited by examiner

*Primary Examiner*—Tho Phan
(74) *Attorney, Agent, or Firm*—Hayes Soloway PC

(57) ABSTRACT

An antenna for providing radiation pattern control contains an antenna housing having a series of reflective steps and at least one rod located above the series of reflective steps. The antenna also contains a radiation element situated within the antenna housing so as to allow the antenna housing to control a pattern of radiation emitted by the radiation element.

17 Claims, 8 Drawing Sheets

SYSTEM AND METHOD FOR PROVIDING ANTENNA RADIATION PATTERN CONTROL

FIELD OF THE INVENTION

The present invention is generally related to antennas, and more particularly is related to providing antenna radiation pattern control.

BACKGROUND OF THE INVENTION

The wireless industry is continuously developing systems with higher data rates to satisfy the need for increased data capacity. In order to achieve higher over-the-air data transmission rates, the number of used channels is increased (i.e., higher over-the-air data rate sectorization) and a higher order modulation is used. In addition, it may be useful to alternate polarization between sectors or use polarization diversity, to enhance throughput.

Unfortunately, with an increase in the number of channels used for data transmission, interference between channels is required to be addressed. As an example, providers of wireless telecommunication technologies are required to ensure that they provide for proper wireless coverage within a specific frequency band, while minimizing interference with other frequency bands. In fact, interfering with other frequency bands may result in breaching of licenses associated with providing communication capabilities within a specific coverage area.

In order to minimize interference, a base station antenna may be required to illuminate a desired sector of transmission as uniformly as possible, while suppressing energy radiated in other directions. Unless controlled, energy may leak into undesired directions, forming small auxiliary beams called sidelobes. It is desirable to minimize or eliminate these sidelobes in order to minimize interference.

Dual polarization antennas transmit the electromagnetic energy in two orthogonal polarizations that are typically horizontal and vertical, but could also be left and right hand circular, or +/−45 degrees. The horizontally polarized component is oriented in a generally horizontal direction and the vertically polarized component is oriented in a generally vertical direction. In addition, the horizontally and vertically polarized components are oriented as orthogonal to one another. Unfortunately, controlling the distribution of radiated energy from a dual polarization antenna is difficult since vertical and horizontal polarized components experience different boundary conditions at material interfaces such as metal and plastic surfaces.

Multiple Input Multiple Output (MIMO) based systems are relatively new. They employ space-time processing to combine multiple signals in a fashion that increases total system throughput. The use of dual polarized antennas for diversity applications is well known to the industry. For example, in cellular telephony dual polarized +/−45 degree antennas are often used for diversity applications. However, their use in MIMO based systems has not been widely explored. In contrast to the antennas used for basic diversity techniques, we find that vertical/horizontal dual polarized antennas are preferred for MIMO based systems. This is due to the fact that most scatterers are either vertically or horizontally oriented. Hence, the maximum differences between signals is realized when vertical/horizontal antennas are used. This results in maximum MIMO system gain.

Thus, a heretofore unaddressed need exists in the industry to address the aforementioned deficiencies and inadequacies.

SUMMARY OF THE INVENTION

Embodiments of the present invention provide an antenna and method for providing radiation pattern control. Briefly described, in architecture, one embodiment of the antenna, among others, can be implemented as follows. The antenna for providing radiation pattern control contains an antenna housing having a series of reflective steps and at least one rod located above the series of reflective steps. The antenna also contains a radiation element situated within the antenna housing so as to allow the antenna housing to control a pattern of radiation emitted by the radiation element.

As mentioned above, the present invention can also be viewed as providing methods for providing radiation pattern control. In this regard, one embodiment of such a method, among others, can be broadly summarized by the following steps: providing a vertical electric field component and a horizontal electric field component to at least one radiator; transmitting the vertical electric field component and the horizontal electric field component via the at least one radiator; and controlling a pattern of radiation emitted by the at least one radiator through use of a series of reflective steps and at least one rod.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

Figure 1:
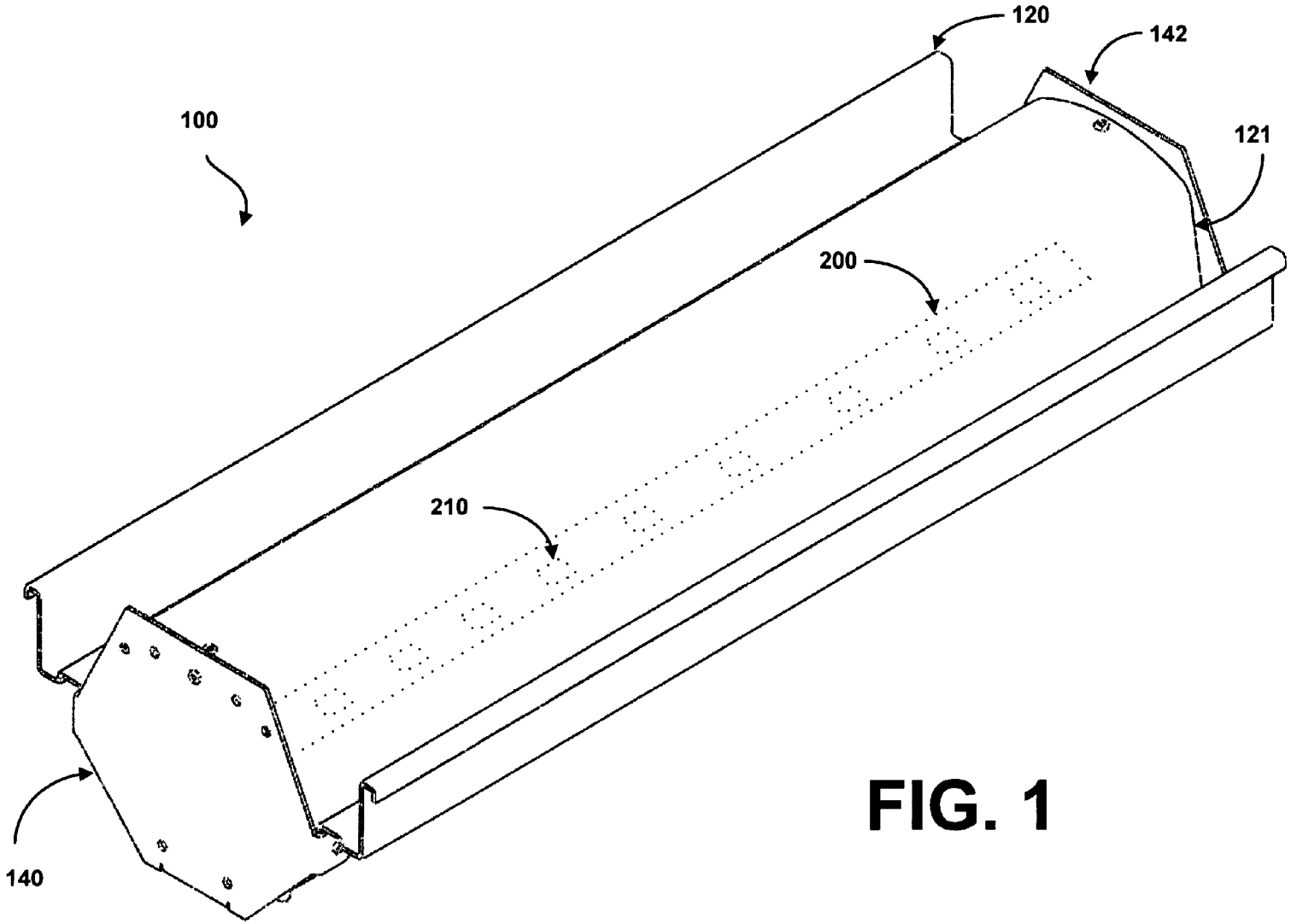
FIG. 1 is a schematic diagram providing a top perspective view of an antenna capable of radiation pattern control.
Figure 9:
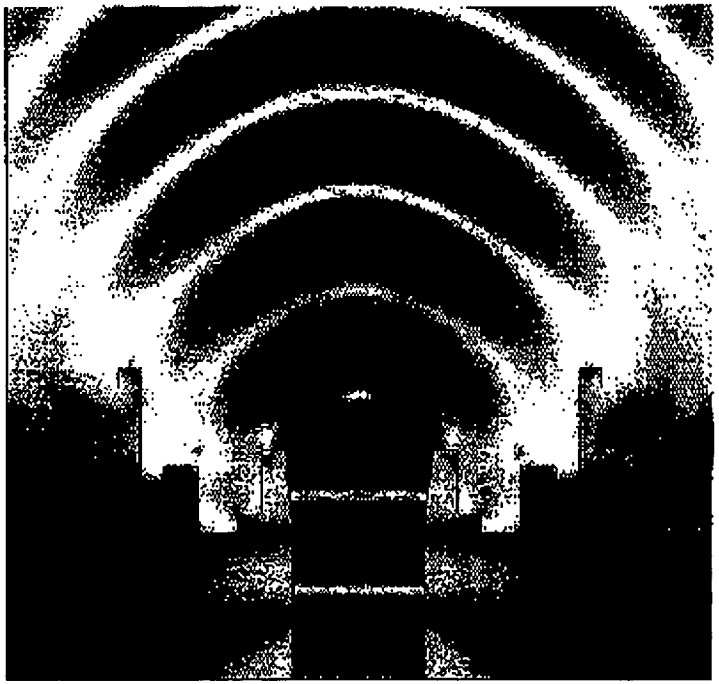

FIG. 9 is an exemplary illustration of a horizontally polarized electric nearfield created by the antenna of FIG. 1 due to radiation pattern control provided by the antenna housing, without having the rods therein.

DETAILED DESCRIPTION

The following describes a system and method for providing radiation pattern control via an antenna. FIG. 1 is a schematic diagram providing a perspective view of an antenna 100 capable of radiation pattern control. It should be noted that, for example, the antenna may be a +/−45 degree dual polarized antenna, a left and right hand circular dual polarized antenna, and/or a singly vertically polarized antenna.

The antenna 100 contains an antenna housing 120 and a radiation element 200. It should be noted that the radiation element 200 is shown as being located beneath a cover portion 121 of the antenna housing 120. The antenna housing 120, which is further illustrated by the schematic diagram of FIG. 2, is designed to provide radiation pattern control for both vertical and horizontal electric field components of radiation emitted from the antenna 100. In addition, the radiation element 200, which is further illustrated by the schematic diagram of FIG. 4, contains a number of radiators 210. It should be noted that the number of radiators may be different from the number of radiators 210 shown in the figures to be located on the radiation element 200. It should also be noted that the size and/or shape of the radiators 210 located on the radiation element 200 may be different from that illustrated by the figures herein.

The cover portion 121 may be made of many different materials such as, but not limited to, thermo-plastics such as different grades of ABS, polycarbonate, polyethylene, polypropylene, or different grades of fabrics or skins, as well as fiberglass reinforced plastics. Specifically, the cover portion 121 of the antenna housing 120 is made of a material that allows electromagnetic energy to flow there through, without significant interference to the electromagnetic radiation pattern provided by the antenna housing 120.

Figure 2A:
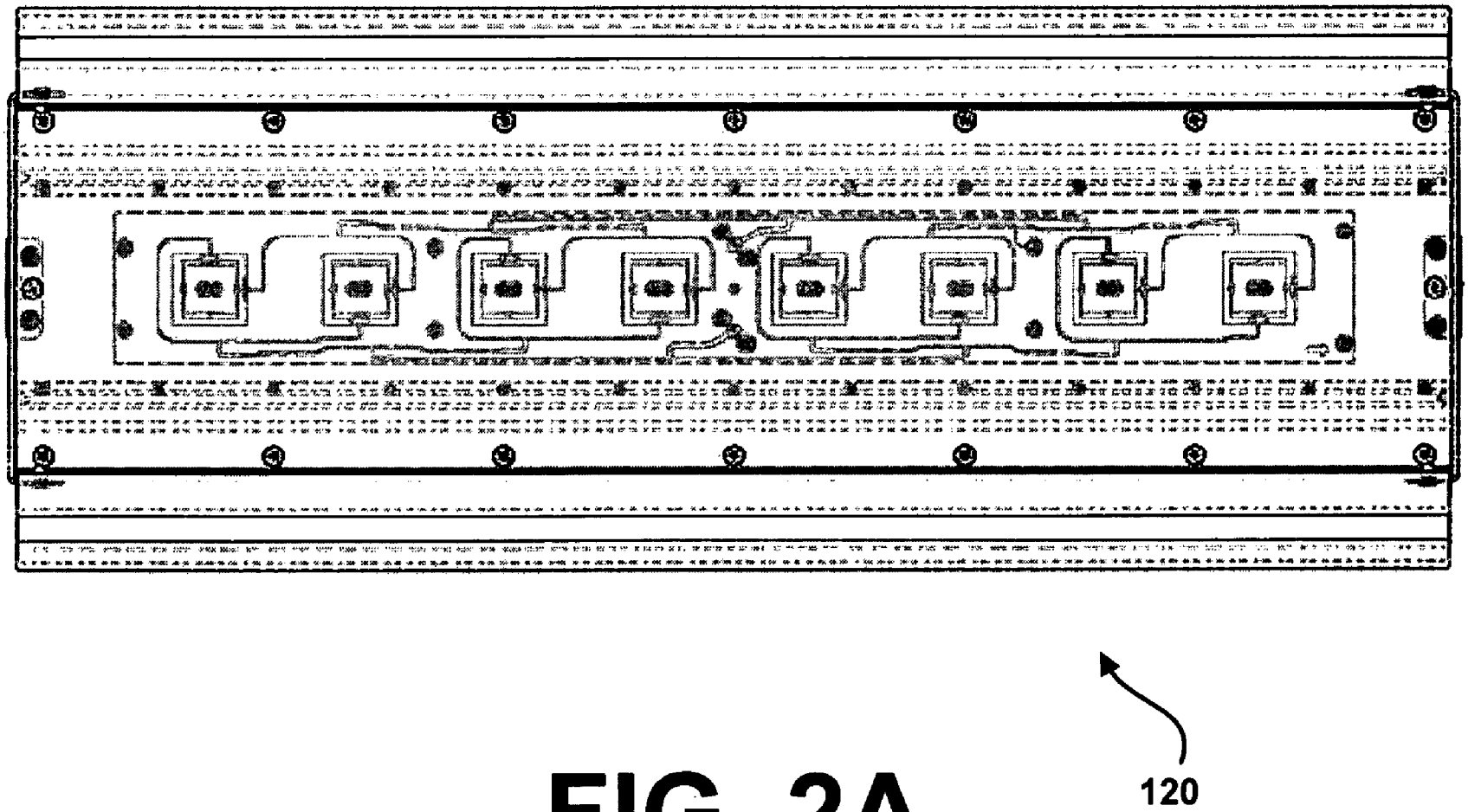
FIG. 2A is a schematic diagram providing a top view of the antenna housing of FIG. 1, having a cover portion removed.
Figure 2B:
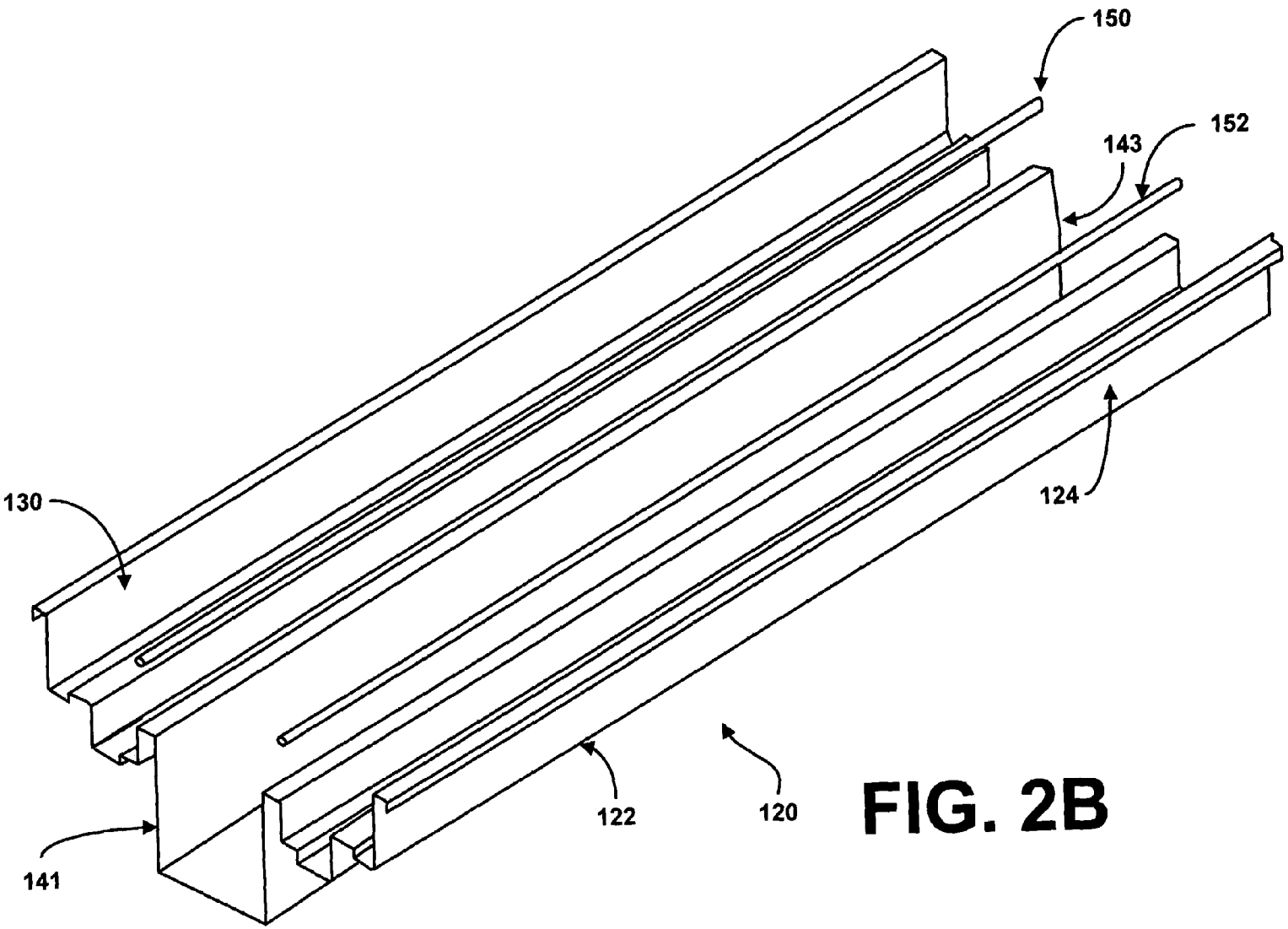
FIG. 2B is a schematic diagram providing a top perspective view of the antenna housing of FIG. 1, having the cover portion, a first side wall, and a second side wall removed.

Referring now to FIG. 2A and FIG. 2B, FIG. 2A is a schematic diagram providing a top view of the antenna housing 120 having the cover portion 121 removed, while FIG. 2B is a schematic diagram providing a top perspective view of the antenna housing of FIG. 1, having the cover portion 121, a first side wall 140, and a second side wall 142 removed for viewing purposes.

As is shown by FIGS. 2A and 2B, the antenna housing 120 is a single conductive element having a series of steps and rods therein for providing radiation pattern control, as is described in detail herein. The antenna housing 120 contains an outer body 122, where the outer body 122 contains an outer surface 124 and an inner surface 130. The antenna housing 120 also contains the first side wall 140 (FIG. 1) and the second side wall 142 (FIG. 1). The first side wall 140 (FIG. 1) and the second side wall 142 (FIG. 1) connect to a first side portion 141 of the outer body 122 and a second side portion 143 of the outer body 122, respectively. Use of the side walls 140, 142 (FIG. 1) allows a first rod 150 and a second rod 152 to be situated above the inner surface 130 of the outer body 122, where a central axis of the first rod 150 and the second rod 152 is parallel to a direction in which the outer body 122 is elongated.

The antenna housing 120 and rods 150, 152 may be fabricated from different materials. Specifically, the material used to fabricate the antenna housing 120 and rods 150, 152 is capable of reflecting electromagnetic energy so as to provide a required radiation pattern. As an example, the antenna housing 120 and rods 150, 152 may be fabricated from aluminum, magnesium, galvanized steel, stainless steel, or conductively coated plastics. In addition, the shape of the antenna housing 120 and rods 150, 152 is dependent upon a required resulting radiation pattern. As an example, while the rods 150, 152 are shown to be circular, any cross sectional shape may be used.

Figure 3:
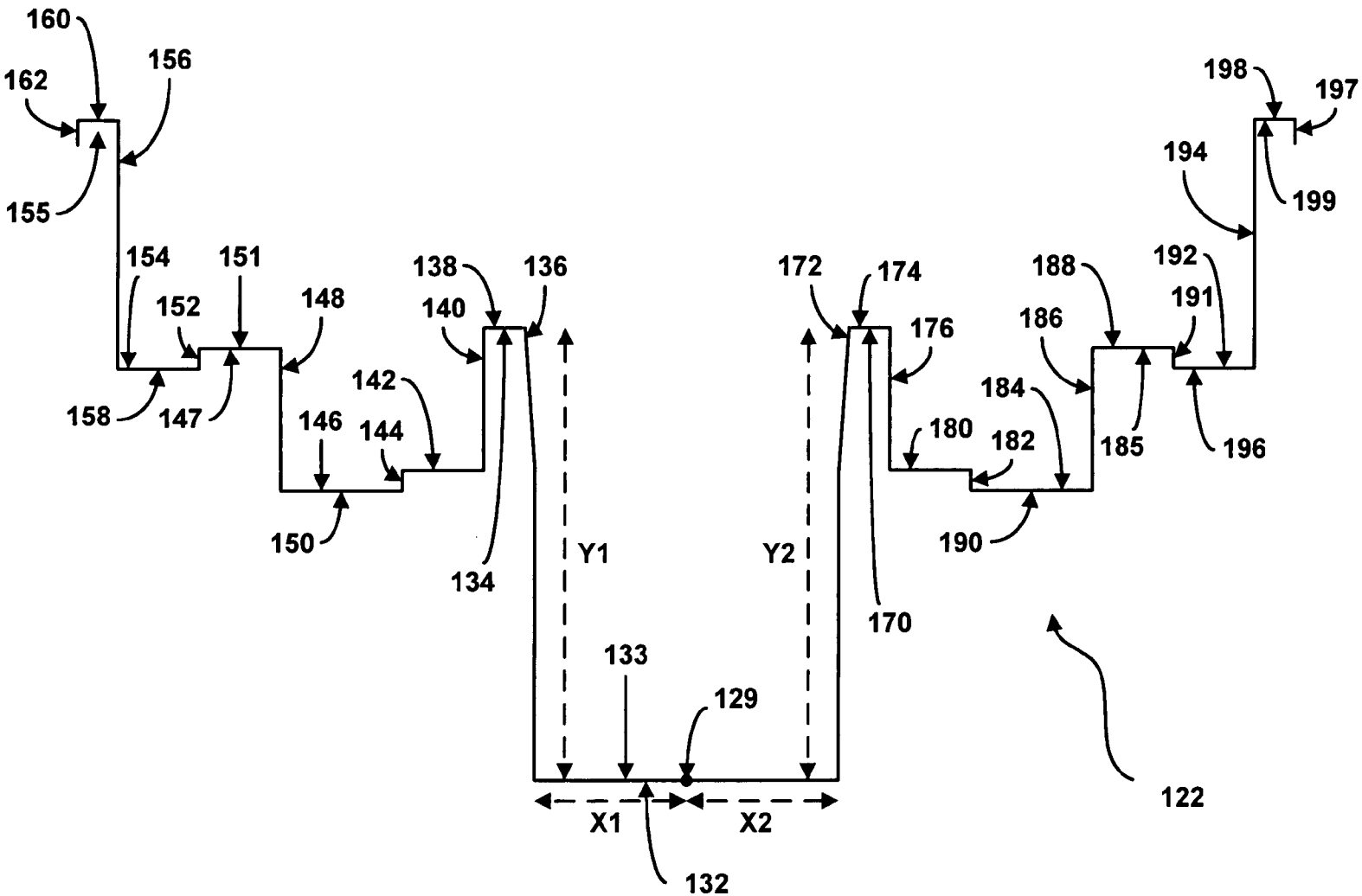
FIG. 3 is a cross-section of the outer body of the antenna housing of FIG. 2, in accordance with the first exemplary embodiment of the invention.

As has been mentioned above, the outer body 122 of the antenna housing 120 contains a series of steps (described in detail below) that assist in providing radiation pattern control by reflecting electromagnetic radiation emitted by the radiation element 200. FIG. 3 is a cross-section of the outer body 122 of the antenna housing 120 in accordance with the first exemplary embodiment of the invention. As is shown by FIG. 3, and as is described in detail below, the inner surface 130 of the outer body 122 is defined by a series of steps and a central trough 132. It should be noted that the shape of the antenna housing 120 is not intended to be limited to the shape described herein. Instead, the antenna housing 120 is intended to have at least one rod extending above the inner surface 130 of the outer body 122 so as to allow shaping of a radiation pattern, where a vertical electric field component of radiation interacts with the at least rod one and is shaped accordingly, while a horizontal electrical field component of the radiation is primarily unaffected by the at least one rod. It should also be noted that, while the antenna housing 120 is illustrated and described as having two rods therein, more or fewer rods may be provided within the antenna housing 120.

Describing the inner surface 130 of the outer body 122, starting from a central point 129 of the inner surface 130, located on a bottom surface 133 of the central trough 132 and extending to the left, a first step 134 begins a distance X1 from the central point 129 of the inner surface 130 with a first step first side portion 136. The first step first side portion 136 extends vertically from the bottom surface 133 of the central trough 132, a distance Y1. In accordance with the first exemplary embodiment of the invention, the first step first side portion 136 meets the bottom surface 133 of the central trough 132 at approximately ninety degrees.

As is shown by FIG. 3, the distance Y1 is larger than other vertical distances within the inner surface 130, except for a distance Y2 discussed below. A first step top portion 138 extends horizontally and meets the first step first side portion 136. As is shown by FIG. 3, an upper portion of the first step first side portion 136 is angled outward away from the central trough 132. Angling of the upper portion of the first step first side portion 136 is provided to assist in shaping of a radiation pattern.

The first step 134 also contains a first step second side portion 140, which extends vertically downward, away from the first step top portion 138. In accordance with the first exemplary embodiment of the invention, the first step second side portion 140 meets the first step top portion 138 at an angle of approximately ninety degrees. The first step second side portion 140 meets a second step top portion 142, where the second step top portion 142 extends horizontally and meets the first step second side portion 140 at approximately ninety degrees. A second step first side portion 144 extends vertically downward from the second step top portion 142 and meets the second step top portion 142 at approximately ninety degrees.

The second step first side portion 144, a first left bottom surface 146 and a third step first side portion 148 define a first left trough 150 located within the outer body 122 of the antenna housing 120. In accordance with the first exemplary embodiment of the invention, the third step first side portion 148 meets the first left bottom surface 146 at approximately ninety degrees. The third step first side portion 148 extends upward in a vertical direction and meets a third step top portion 151, where the third step top portion 151 extends in a horizontal direction. The third step first side portion 148 meets the third step top portion 151 at approximately ninety degrees.

A third step second side portion 152 meets the third step top portion 151 and extends downward in a vertical direction. As is shown by FIG. 3, the third step second side portion 152 meets the third step top portion 151 at approximately ninety degrees. The third step first side portion 148, the third step top portion 151 and the third step second side portion 152 define a third step 147 of the outer body 122.

The third step second side portion 152, a second left bottom surface 154, and a fourth step first side portion 156 define a second left trough 158 located within the outer body 122 of the antenna housing 120. In accordance with the first exemplary embodiment of the invention, the fourth step first side portion 156 meets the second left bottom surface 154 at approximately ninety degrees.

The fourth step first side portion 156 extends upward in a vertical direction and meets a fourth step top portion 160, where the fourth step top portion 160 extends in a horizontal direction. The fourth step first side portion 156 meets the fourth step top portion 160 at approximately ninety degrees. A fourth step second side portion 162 meets the fourth step top portion 160 and extends vertically downward from the fourth step top portion 160. In accordance with the first exemplary embodiment of the invention, the fourth step second side portion 162 meets the fourth step top portion 160 at approximately ninety degrees. The fourth step first side portion 156, the fourth step top portion 160, and the fourth step second side portion 162 define a fourth step 155 of the outer body 122.

Returning to the central point 129 of the inner surface 130, it should be noted that everything to the right of the central point 129 of the inner surface 130, which has not been described thus far, is a mirror image of everything to the left of the central point 129 of the inner surface 130, as described hereinabove.

Describing the inner surface 130 of the outer body 122, starting from the central point 129 of the inner surface 130, located on the bottom surface 133 of the central trough 132 and extending to the right, a fifth step 170 begins a distance X2 from the central point 129 of the inner surface 130 with a fifth step first side portion 172. It should be noted that distance X1 is preferably equal to distance X2, although in accordance with alternative embodiments of the invention, the distances may be different.

The fifth step first side portion 172 extends vertically from the bottom surface 133 of the central trough 132, a distance Y2. In accordance with the first exemplary embodiment of the invention, the fifth step first side portion 172 meets the bottom surface 133 of the central trough 132 at approximately ninety degrees.

As is shown by FIG. 3, the distance Y2 is preferably equal to the distance Y1. A fifth step top portion 174 extends horizontally and meets the fifth step first side portion 172. As is shown by FIG. 3, an upper portion of the fifth step first side portion 172 is angled outward away from the central trough 132. Angling of the upper portion of the fifth step first side portion 172 is provided to assist in shaping of a radiation pattern.

The fifth step 170 also contains a fifth step second side portion 176, which extends vertically downward, away from the fifth step top portion 174. In accordance with the first exemplary embodiment of the invention, the fifth step second side portion 176 meets the fifth step top portion 174 at an angle of approximately ninety degrees. The fifth step second side portion 176 meets a sixth step top portion 180, where the sixth step top portion 180 extends horizontally and meets the fifth step second side portion 176 at approximately ninety degrees. A sixth step first side portion 182 extends vertically downward from the sixth step top portion 180 and meets the sixth step top portion 180 at approximately ninety degrees.

The sixth step first side portion 182, a first right bottom surface 184 and a seventh step first side portion 186 define a first right trough 190 located within the outer body 122 of the antenna housing 120. In accordance with the first exemplary embodiment of the invention, the seventh step first side portion 186 meets the first right bottom surface 184 at approximately ninety degrees. The seventh step first side portion 186 extends upward in a vertical direction and meets a seventh step top portion 188, where the seventh step top portion 188 extends in a horizontal direction. The seventh step first side portion 186 meets the seventh step top portion 188 at approximately ninety degrees.

A seventh step second side portion 191 meets the seventh step top portion 188 and extends downward in a vertical direction. As is shown by FIG. 3, the seventh step second side portion 191 meets the seventh step top portion 188 at approximately ninety degrees. The seventh step first side portion 186, the seventh step top portion 188 and the seventh step second side portion 191 define a seventh step 185 of the outer body 122.

The seventh step second side portion 191, a second right bottom surface 192, and an eighth step first side portion 194 define a second right trough 196 located within the outer body 122 of the antenna housing 120. In accordance with the first exemplary embodiment of the invention, the seventh step first side portion 194 meets the second right bottom surface 192 at approximately ninety degrees.

The eighth step first side portion 194 extends upward in a vertical direction and meets an eighth step top portion 198, where the eighth step top portion 198 extends in a horizontal direction. The eighth step first side portion 194 meets the eighth step top portion 198 at approximately ninety degrees. An eighth step second side portion 197 meets the eighth step top portion 198 and extends vertically downward from the eighth step top portion 198. In accordance with the first exemplary embodiment of the invention, the eighth step second side portion 197 meets the eighth step top portion 198 at approximately ninety degrees. The eighth step first side portion 194, the eighth step top portion 198, and the eighth step second side portion 197 define an eighth step 199 of the outer body 122.

Figure 4:
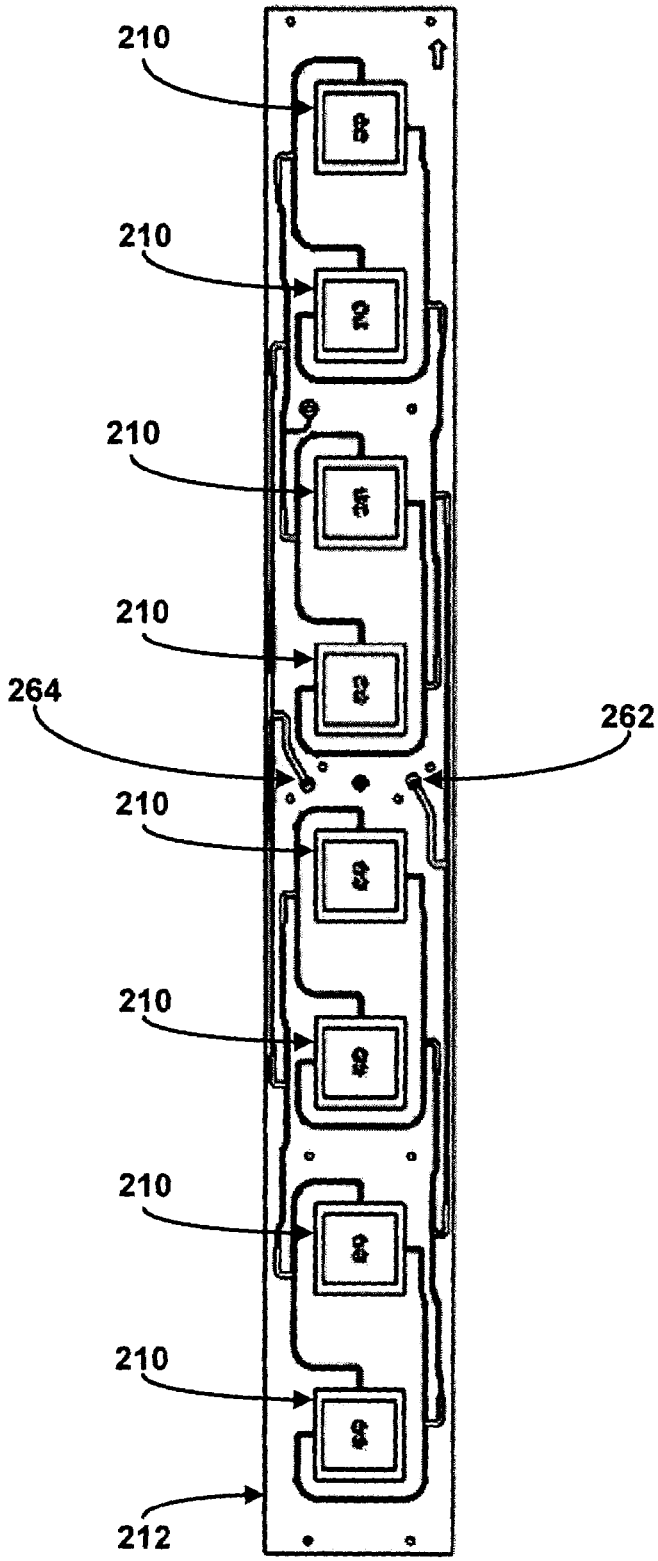
FIG. 4 is a schematic diagram illustrating the radiation element of FIG. 1, in accordance with the first exemplary embodiment of the invention.

FIG. 4 is a schematic diagram illustrating the radiation element 200 of FIG. 1, in accordance with the first exemplary embodiment of the invention. As is shown by FIG. 4, the radiation element 200 contains a number of radiators 210 thereon. It should be noted that the number of radiators 210 may be different from the number of radiators 210 shown in the figures to be located on the radiation element 200. It should also be noted that the size and/or shape of the radiators 210 located on the radiation element 200 may be different from that illustrated by the figures herein.

In accordance with the first exemplary embodiment of the invention, the radiators 210 are etched into a printed circuit board 212 so as to allow the radiators 210 to emit electromagnetic radiation provided by a source of the vertical polarized components and a source of the horizontal polarized components. Specifically, the radiators 210 may be made of any material capable of emitting electromagnetic radiation. In addition, the radiators 210 may be created by use of a method different from etching. One having ordinary skill in the art would know of such other methods of creation. It should also be noted that the radiators 210 may be provided in a form different from located on a printed circuit board.

The electromagnetic energy is distributed from the connectors 250 and 252 on the back side of the antenna to the radiators 210 through a beam forming network, such as, but not limited to copper traces etched on a printed circuit board As was shown by FIG. 1, the radiation element 200 is located within the central trough 132 of the antenna housing 120. As an example, the radiation element 20 may be connected or fastened to the bottom surface 133 of the central trough 132.

Figure 5:
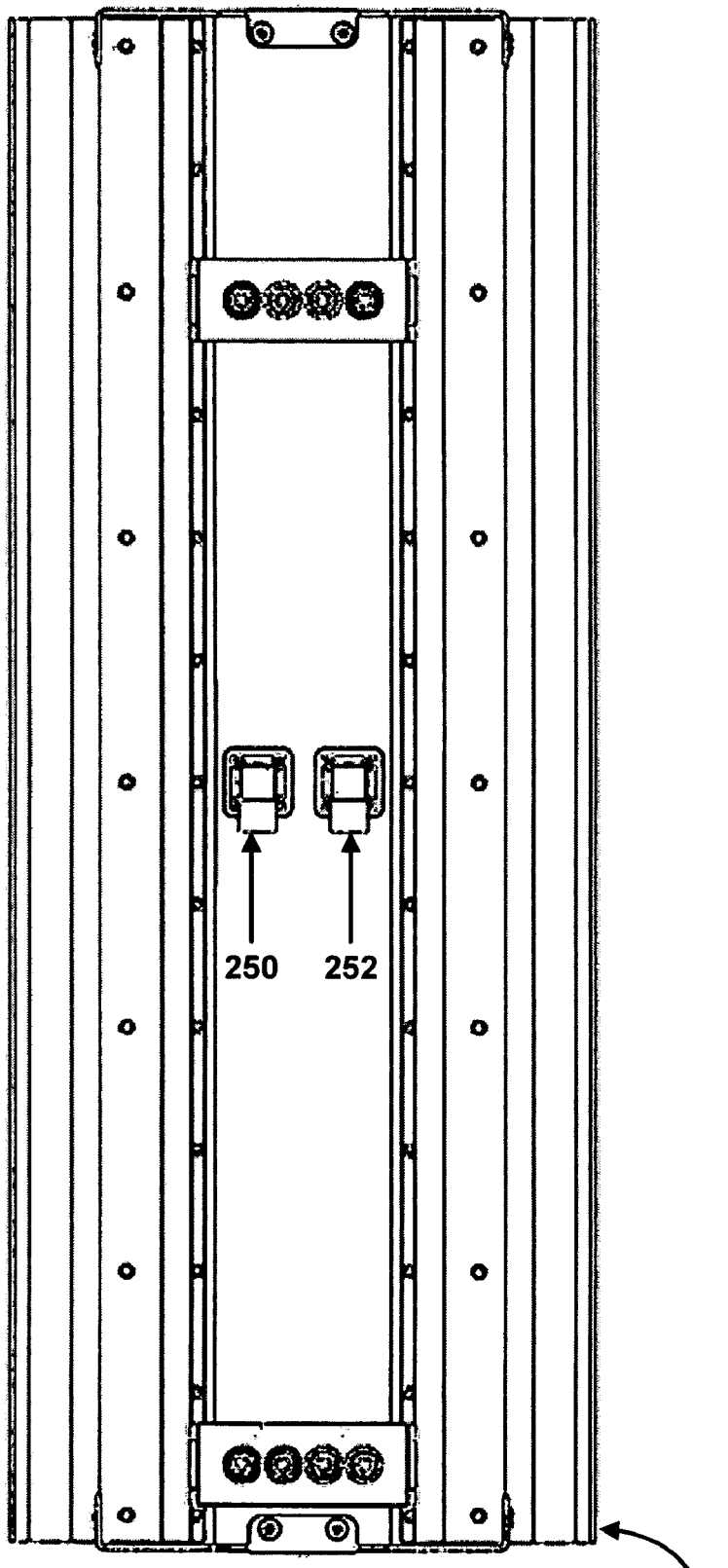
FIG. 5 is a schematic diagram illustrating a back portion of the antenna housing of FIG. 1.

FIG. 5 is a schematic diagram illustrating a back portion of the antenna housing 120 of FIG. 1. As is shown by FIG. 5 the antenna housing 120 has a first connection point 250 and a second connection point 252. The first connection point 250 allows a vertical electric field component of radiation to enter the antenna housing 120. In addition, the second connection point 252 allows a horizontal electric field component of radiation to enter the antenna housing 120.

Referring to both FIG. 4 and FIG. 5, the first connection point 250 conductively connects to a first conductive point 262 located on the radiation element 200, while the second connection point 252 conductively connects to a second conductive point 264 located on the radiation element 200. Specifically, conductive paths may be provided within the antenna housing 120 to allow the vertical electric field component to travel from the first connection point 250 to the first conductive point 262, and the horizontal electric field component to travel from the second connection point 252 to the second conductive point 264.

Conductive paths are located within the radiation element 200, from each of the conductive points 262, 264 to specific radiators 210 located on the printed circuit board 212. As a result of the conductive paths, each radiator 210 emits a vertical electric field component and a horizontal electric field component independent of each other.

As mentioned above, the two rods 150, 152 extending above the inner surface 130 of the outer body 122 allow shaping of a radiation pattern, where the vertical electric field component of radiation interacts with the rods 150, 152 and is shaped accordingly, and where the horizontal electrical field component of the radiation is primarily unaffected by the rods 150, 152. The reason for this can be found in the expressions for the scattering cross section of a thin conducting cylinder. The scattering cross section diminishes as the inverse of the logarithm of the cylinder radius squared for the vertical polarization, and for the horizontal polarization the scattering cross section diminishes as the cylinder radius to the fourth power. For a cylinder diameter that is $1/20^{th}$ of the wavelength of the electromagnetic wave the power in the vertically polarized scattered wave is several orders of magnitude higher than the power in the horizontally polarized scattered wave. The electric field scattered off the rods 150, 152 helps shape the radiation pattern in a direct manner by adding to the radiation pattern directly, and indirectly by redirecting energy to the reflector steps that then reflects the electric field in a controlled manner that adds to the radiation pattern. The exact location of the rods 150, 152 can be determined either by calculating the electromagnetic fields by solving Maxwell's equations, or by empirical trials based on electromagnetic field measurements.

In addition, the rods 150, 152 act to suppress side lobes as is further illustrated by FIGS. 6–9, which are described in detail hereafter.

Figure 7:
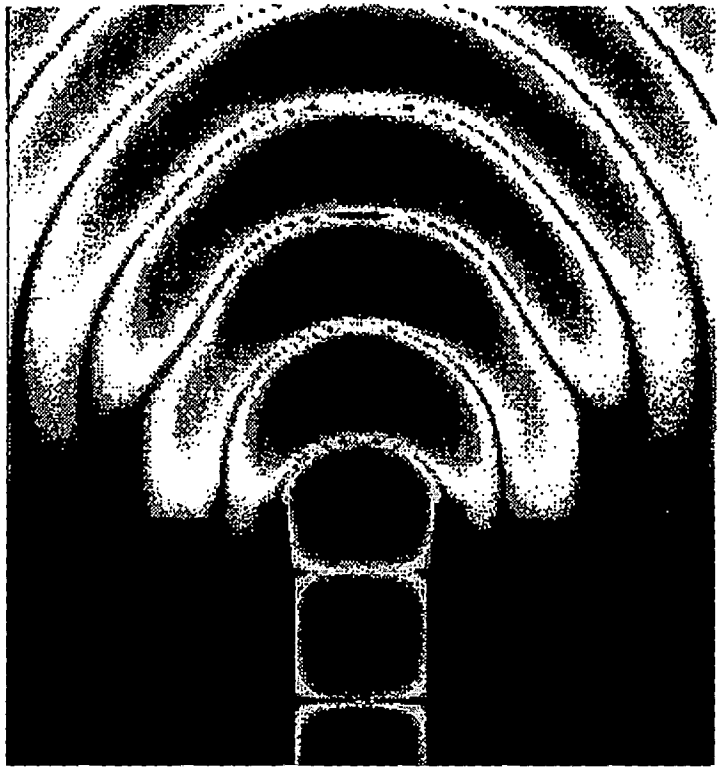
FIG. 7 is an exemplary illustration of a vertically polarized electric nearfield created by the antenna of FIG. 1 due to radiation pattern control provided by the antenna housing, without having the rods therein.
Figure 6:
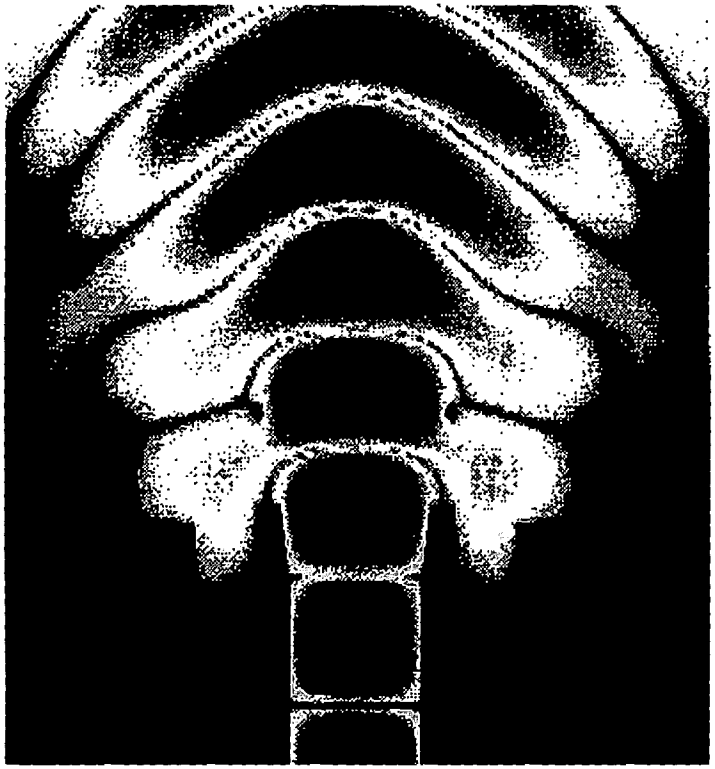
FIG. 6 is an exemplary illustration of a vertically polarized electric nearfield created by the antenna of FIG. 1 due to radiation pattern control provided by the antenna housing, having the rods therein.

FIG. 6 is an exemplary illustration of a vertically polarized electric nearfield created by the present antenna 100 due to radiation pattern control provided by the antenna housing 120, having the rods 150, 152 therein. For comparative purposes, FIG. 7 is an exemplary illustration of a vertically polarized electric nearfield created by the present antenna 100 due to radiation pattern control provided by the antenna housing 120 without having the rods 150, 152 therein. As is shown by FIG. 6, the vertical electric field component of radiation interacts with the rods and is shaped accordingly.

Figure 8:
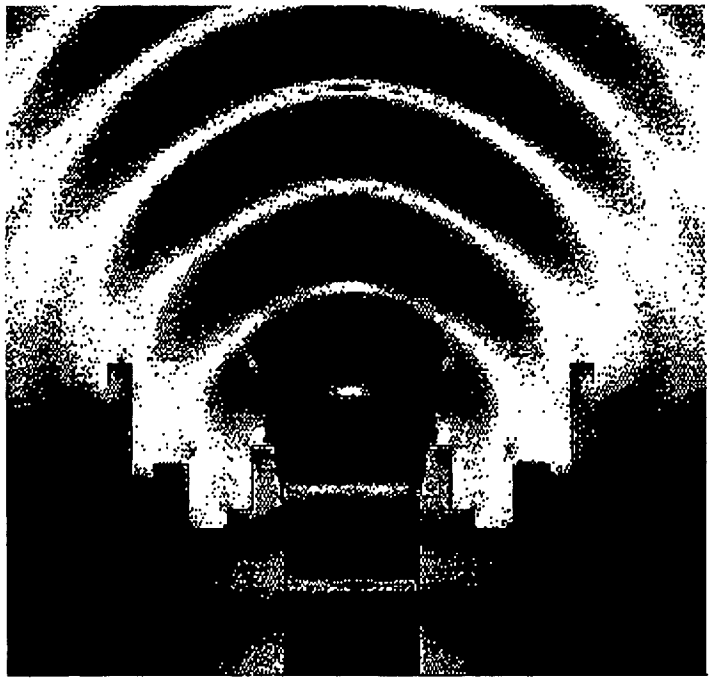
FIG. 8 is an exemplary illustration of a horizontally polarized electric nearfield created by the antenna of FIG. 1 due to radiation pattern control provided by the antenna housing, having the rods therein.

FIG. 8 is an exemplary illustration of a horizontally polarized electric nearfield created by the present antenna 100 due to radiation pattern control provided by the antenna housing 120, having the rods 150, 152 therein. For comparative purposes, FIG. 9 is an exemplary illustration of a horizontally polarized electric nearfield created by the present antenna 100 due to radiation pattern control provided by the antenna housing 120 without having the rods 150, 152 therein. As is shown by FIG. 8, the horizontal electrical field component of the radiation is primarily unaffected by the rods.

It should be noted that the antenna 100 polarized nearfields of FIGS. 6–9 are derived from an antenna that is designed to cover a sixty-degree sector with a power roll-off of 3 dB at +/−thirty-degree sector edges. Side lobe levels are designed to be suppressed more than 30 dB for azimuth angles beyond +/−90 degrees from a forward direction. Of course, the design mentioned herein is merely exemplary since other designs may be used as well, thereby providing coverage of different sectors, with a different power roll-off, and with a different amount of suppression of side lobe levels. It should be noted that use of the rods may make it possible to control the radiation pattern over a large frequency bandwidth since there is a large degree of freedom in design of the antenna, specifically, the placement of the rods and shape of the antenna overall.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. An antenna for providing radiation pattern control, comprising:

an antenna housing comprising a series of reflective steps and at least one rod located above said series of reflective steps; and a radiation element situated within said antenna housing so as to allow said antenna housing to control a pattern of radiation emitted by said radiation element.

2. The antenna of claim 1, wherein said radiation element further comprises at least one radiator capable of emitting electromagnetic energy, where said electromagnetic energy comprises a vertical electric field component and a horizontal electric field component.

3. The antenna of claim 2, wherein said antenna housing further comprises:

a cover capable of being placed over said reflective steps, where said cover does not effect a radiation pattern of said antenna; and at least one connection point for receiving said vertical electric field component and said horizontal electric field component.

4. The antenna of claim 3, wherein said antenna housing conductively allows said vertical electric field component and said horizontal electric field component to be received by said radiation element.

5. The antenna of claim 4, wherein said vertical electric field component emitted by said at least one radiator interacts with said at least rod one and is shaped accordingly, while said horizontal electrical field component is primarily unaffected by said at least one rod.

6. The antenna of claim 1, wherein said series of reflective steps further comprises a first set of reflective steps and a second set of reflective steps, wherein said first set of reflective steps is a mirror-image of said second set of reflective steps.

7. The antenna of claim 1, wherein said radiation element further comprises a printed circuit board and at least one radiator located on said printed circuit board, said at least one radiator being capable of emitting electromagnetic energy, where said electromagnetic energy comprises a vertical electric field component and a horizontal electric field component.

8. The antenna of claim 7, wherein said radiation element is located within a central trough of said antenna housing.

9. The antenna of claim 1, wherein said antenna housing further comprises a first side wall and a second side wall, said at least one rod being connected to said first side wall and said second side wall so as to allow said at least one rod to remain located above said series of reflective steps.

10. The antenna of claim 1, wherein said radiation element further comprises at least one radiator capable of emitting electromagnetic energy, where said electromagnetic energy comprises a vertical electric field component.

11. The antenna of claim 1, wherein said radiation element further comprises at least one radiator capable of emitting electromagnetic energy, where said electromagnetic energy comprises a horizontal electric field component.

12. The antenna of claim 1, wherein said antenna is a +/−45 degree dual polarized antenna.

13. The antenna of claim 1, wherein said antenna is a left and right hand circular dual polarized antenna.

14. The antenna of claim 1, wherein said antenna is a singly vertically polarized antenna.

15. A method of providing radiation pattern control, comprising the steps of:

providing a vertical electric field component and a horizontal electric field component to at least one radiator;

transmitting said vertical electric field component and said horizontal electric field component via said at least one radiator; and controlling a pattern of radiation emitted by said at least one radiator through use of a series of reflective steps and at least one rod.

16. The method of claim 15, where said step of controlling said pattern of radiation further comprises the step of shaping said vertical electric field component, while leaving said horizontal electrical field component primarily unaffected.

17. An antenna for providing radiation pattern control, comprising:

means for radiating, said means for radiating being capable of transmitting a vertical electric field component and a horizontal electric field component;

means for providing said vertical electric field component and said horizontal electric field component to said means for radiating; and means for controlling a pattern of radiation emitted by said means for radiating through use of a series of reflective steps and at least one rod.

* * * * *

UNITED STATES PATENT AND TRADEMARK OFFICE

CERTIFICATE OF CORRECTION

PATENT NO. : 7,180,469 B2
APPLICATION NO. : 11/169467
DATED : February 20, 2007
INVENTOR(S) : Slattman et al.

It is certified that error appears in the above-identified patent and that said Letters Patent is hereby corrected as shown below:

Col. 9, Claim 5, Line 18, “rod one” should be --one rod--.

Signed and Sealed this

Twenty-second Day of May, 2007

JON W. DUDAS
*Director of the United States Patent and Trademark Office*